United States Patent [19]

Ozawa et al.

[11] Patent Number: 4,487,517

[45] Date of Patent: Dec. 11, 1984

[54] PRINTER ADAPTED TO PERFORM MARGIN/TABULATOR SETTING FUNCTION

[75] Inventors: Toshiaki Ozawa, Urayasu; Yasuaki Yamada, Funabashi; Hiroatsu Kondo, Zushi, all of Japan

[73] Assignee: Canon Kabushiki Kaisha, Tokyo, Japan

[21] Appl. No.: 431,065

[22] Filed: Sep. 30, 1982

Related U.S. Application Data

[63] Continuation of Ser. No. 138,982, Apr. 10, 1980, abandoned.

[30] Foreign Application Priority Data

| | | | |
|---|---|---|---|
| Apr. 27, 1979 | [JP] | Japan | 54-52990 |
| Apr. 27, 1979 | [JP] | Japan | 54-52991 |
| Jul. 5, 1979 | [JP] | Japan | 54-84391 |

[51] Int. Cl.[3] ..... B41J 21/02

[52] U.S. Cl. ..... 400/279; 400/298; 400/342; 400/351; 400/705.4

[58] Field of Search ..... 400/233, 279, 283, 295, 400/295.1, 295.2, 298, 320, 342, 343, 344, 351, 479.2, 490, 692, 705.1, 705.4, 708

[56] References Cited

U.S. PATENT DOCUMENTS

| | | | |
|---|---|---|---|
| 1,142,800 | 6/1915 | Crutchley | 400/298 X |
| 1,249,456 | 12/1917 | Myers | 400/298 |
| 1,730,040 | 10/1929 | Kurowski | 400/295.1 X |
| 2,852,120 | 9/1958 | Braun et al. | 400/298 |
| 2,910,163 | 10/1959 | Hanson et al. | 400/279 X |
| 3,137,381 | 6/1964 | Behr et al. | 400/295 X |
| 3,403,386 | 9/1968 | Perkins et al. | 400/279 X |
| 3,651,914 | 3/1972 | Locke | 400/344 X |
| 3,749,223 | 7/1973 | Guzak, Jr. | 400/279 |
| 3,973,662 | 8/1976 | Fulton | 400/342 X |
| 4,169,685 | 10/1979 | Gruber | 400/279 X |
| 4,225,249 | 9/1980 | Kettler et al. | 400/279 X |
| 4,273,457 | 6/1981 | Noda | 400/344 X |

FOREIGN PATENT DOCUMENTS

| | | | |
|---|---|---|---|
| 2749976 | 5/1978 | Fed. Rep. of Germany | 400/343 |
| 1007438 | 10/1965 | United Kingdom | 400/279 |

*Primary Examiner*—Ernest T. Wright, Jr.

*Attorney, Agent, or Firm*—Fitzpatrick, Cella, Harper & Scinto

[57] ABSTRACT

There is disclosed a printing apparatus having control equipment for controlling the printing position. The control equipment is detachably mounted on the printing apparatus.

9 Claims, 13 Drawing Figures

PRINTER ADAPTED TO PERFORM MARGIN/TABULATOR SETTING FUNCTION

This is a continuation, of application Ser. No. 138,982, filed Apr. 10, 1980, now abandoned.

BACKGROUND OF THE INVENTION

1. Field of the Invention

The present invention relates to a printing apparatus such as a typewriter or printer having a tabulator/margin setting device for tabulation or margin setting, and more particularly to such apparatus capable of controlling the printing operation in response to the tabulation or margin set positions of said device identified by the open/closed state of switch means.

2. Description of the Prior Art

Conventional typewriters are provided with left-right margin setting bars which can be set at arbitrary positions for selected desired print start and end positions. Also already known in such typewriters is a tabulator device for conducting a spacing function without printing operation in the spaces wherein the printing operation is not required between the left- and right-end positions.

In conventional typewriters said margin setting bars, being generally positioned in the front side of the typewriter, are easily manipulated and allow visual confirmation of the margin set positions in relation to the current printing position. On the other hand the conventional tabulator device is defective in that the set positions for tabulation cannot be visually recognized but can only be confirmed when the carriage bearing the printing means or the platen bearing the recording paper is stopped at one of said set positions after a spacing function. This defect is due to the difficulty of placing a mechanical tabulator device in the front side of the typewriter.

Also tabulator setting in conventional typewriters requires a three-step operation of displacing the carriage, stopping the carriage at a desired set position and actuating a tabulator setting key in the keyboard. In addition such tabulator setting can be cleared only for each set position by actuating a tabulator key to displace the carriage to said set position and actuating a tabulator clear key, so that plural tabulation set positions need to be cleared by the repetition of the above-mentioned procedure for each set position.

Such known tabulator/margin setting devices rely on mechanical control through plural levers for setting or clearing of the tabulator or margin positions and are inevitably associated with insufficient reliability. In order to avoid such drawbacks there has been proposed the use of electronic components in place of mechanical parts for improving the reliability and achieving multiple functions. The so-called electronic tabulator utilizing electronic control performs the tabulation or margin-setting functions through the comparison of the current carriage position with the tabulation or margin set positions previously stored in an electronic memory, and provides a simpler structure and a higher reliability in comparison with the conventional mechanical tabulator/margin-setter. However such an electronic tabulator is still defective in that the data of tabulation or margin set positions stored in a destructable memory are lost when the power supply is interrupted, and this defect can only be prevented by the use of an expensive nondestructable memory.

SUMMARY OF THE INVENTION

An object of the present invention is to provide a tabulator/margin-setting device allowing visual confirmation of the tabulator set positions thereby avoiding the inconvenience in conventional typewriters of recognition of said set positions.

Another object of the present invention is to provide a typewriter allowing tabulator setting/clearing, including margin setting/clearing, in a single-step operation.

Still another object of the present invention is to provide a printing apparatus provided with a tabulator/margin-setting device which provides high reliability in a simple inexpensive structure and avoids the erasure of the data of tabulator/margin set positions even when the power supply is interrupted, thus preventing the drawbacks and retaining the advantages of the aforementioned mechanical and electronic tabulators.

Still other objects of the present invention will be made apparent from the following description of the preferred embodiments to be taken in conjunction with the attached drawing.

DESCRIPTION OF THE PREFERRED EMBODIMENTS

Figure 1:
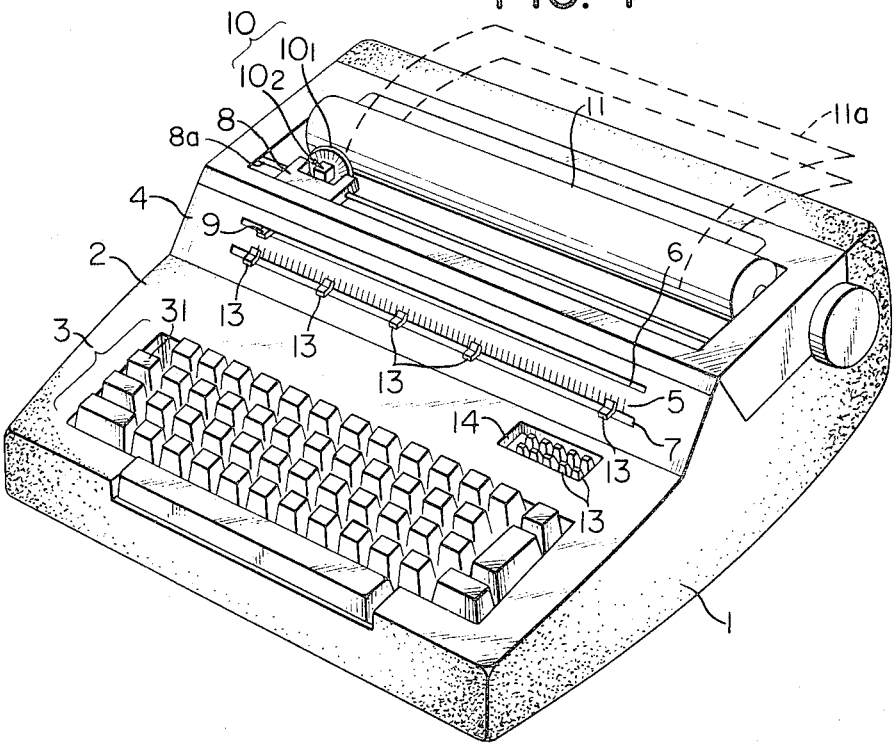
FIG. 1 is a perspective view of a printer embodying the present invention.

Reference is made to FIG. 1 showing a typewriter embodying the present invention in a perspective view, wherein an outer casing 1 is provided with an approximately horizontal key operating plane 2 having a keyboard 3 therein and an easily visible panel 4 connected to the rear end of said key operating plane 2 at a substantially vertical angle and standing in substantially facing relationship to the operator of the apparatus. Said panel 4 is provided in the center thereof with a laterally extended scale 5 having printed graduations corresponding to the positions of the print digits, and further with two slits 6, 7 extending parallel to said scale 5 on both the top and bottom thereof.

A carriage 8 bearing printing means 10 is displaced from left to right parallel to the axial direction of a platen 11 along a guide rod 8*a* provided parallel thereto to perform printing during said displacement on a printing paper (represented in phantom at 11*a*) to be supported by said platen 11. The illustrated printing means 10 is composed as an example of a rotary typefont wheel $\mathbf{10}_1$ and a typefont hitting plunger $\mathbf{10}_2$. Upon completion of the printing of a line, the carriage 8 is returned to the print start position at the left-hand end.

A carriage indicator 9 is integrally fixed at the base portion thereof to said carriage 8 and is extended at the front end portion through said slit 6 to the front side of said panel 4. Said indicator 9 is displaced from left to right along the slit 6 together with the displacement of the carriage 8 or with the proceeding of the printing to indicate the current printing position on the scale 5.

Along and behind the lower slit 7 on the panel 4, there is provided a switch panel 12 having a plurality of switches (16, 17, and 18) arranged, as explained in the following, along the longitudinal direction of said switch panel 12 and corresponding to the positions of print digits. In the present embodiment one or a desired number of tabulator setting keys 13 are inserted at the desired digit positions in the slit 7 to close the switches (16, 17, and 18) in said digit positions on said switch panel 12 thereby achieving tabulator settings at said digit positions. In a suitable portion on said key operating plane 2 there is formed a recess 14 for storing unused tabulator setting keys 13.

Figure 5:
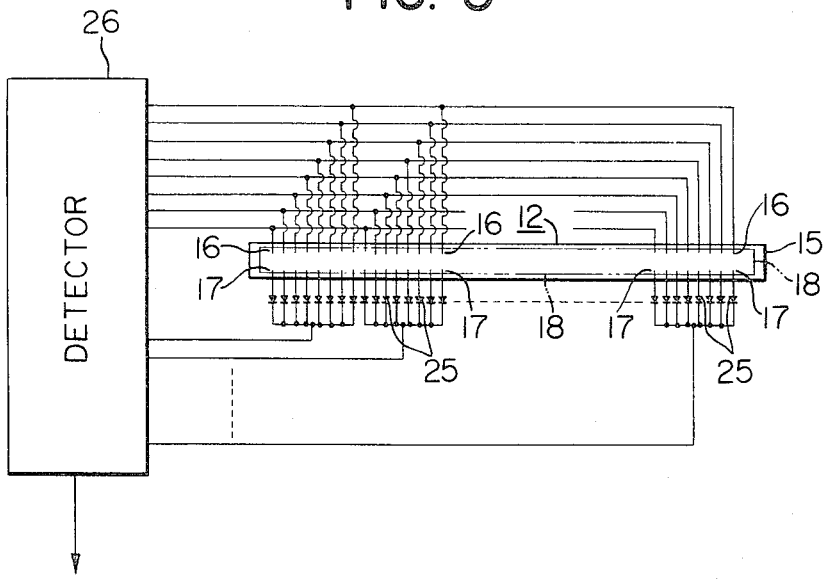
FIG. 5 is a circuit diagram for said printer.

Said switch panel 12 is composed of a printed circuit board 15 extending along said slit 7 and having thereon conductive patterns constituting plural pairs of switch terminals 16, 17 respectively corresponding to the print digits, each pair of terminals 16, 17 being bridged by a pressure-sensitive electroconductive member 18 showing electroconductivity in response to a mechanical pressure. Said pressure-sensitive member 18 may be provided for each pair of terminals 16, 17 or in a continuous manner for all the paired terminals 16, 17 as shown in FIG. 5.

Figure 3:
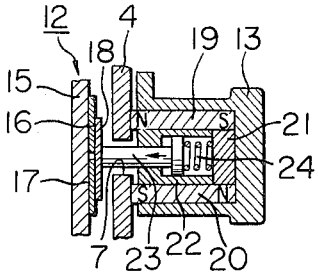
FIG. 3 is a lateral cross-sectional view of the switch panel and a tabulator setting key set therein.

Each tabulator setting key 13 is provided, as shown in FIG. 3, with a pair of magnets 19, 20, a yoke 21 connecting said magnets 19, 20, a cylinder 22 and a push-bar 23 slidably accomodated in said cylinder 22. The push-bar 23 is constantly maintained in a position protruding from the bottom face of the key 13 by a spring 24 provided in said cylinder 22. Also said magnets 19, 20 are mounted so as to be slightly protruding from said bottom face.

Figure 4:
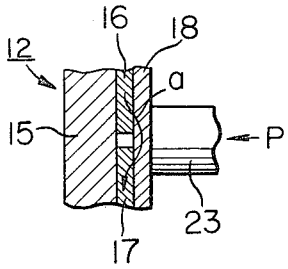
FIG. 4 is a partial magnified view thereof.

When the tabulator setting key 13 of the abovementioned structure is held with the operator's fingers and the protruding push-bar 23 is inserted into the slit 7 of the panel 4, the front end of said push-bar 23 comes into contact with the surface of said pressure-sensitive member 18 on the switch panel 12. If the key 13 is further pushed towards the panel 4 against the biasing force of said spring 24, the magnets 19, 20 come into contact with the panel 4 made of a magnetic material whereby said magnets 19, 20 are adhered to said panel 4 and stably support the key 13 on the panel 4 against the biasing force of the spring 24. The pressure-sensitive member 18 is maintained, in an area contacting the end face of the push-bar 23, under a pressure P generated by the biasing force of the spring 24 to create a conductive path (depicted by a) between the corresponding pair of terminals 16, 17 thereby generating a tabulator setting signal. FIG. 4 shows the current flow from a terminal 16 to another terminal 17 through an area of the pressure-sensitive member 18 which is rendered electroconductive in response to the pressure exerted by the push-bar 23.

In this manner, upon insertion of tabulator setting keys 13 in arbitrary positions along the scale 5, the terminals 16, 17 in the corresponding digit positions on the switch panel 12 are rendered conductive to provide signals for achieving tabulator settings in said positions.

Figure 2:
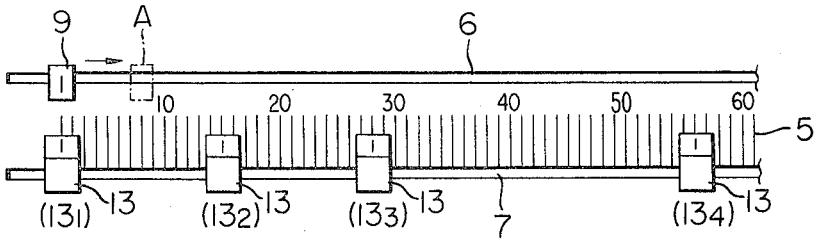
FIG. 2 is a magnified partial elevation view of the panel in which tabulator setting keys are set in certain positions.

FIG. 2 shows an example of tabulator setting at the 1st, 15th, 28th and 56th digits by the insertion of four tabulator setting keys $\mathbf{13}_1$, $\mathbf{13}_2$, $\mathbf{13}_3$ and $\mathbf{13}_4$ in the corresponding positions in the scale 5, wherein the left-end key $\mathbf{13}_1$ defines the so-called left-margin position from which the printing is initiated while the right-end key $\mathbf{13}_4$ defines the so-called right-margin position at which the printing operation is terminated. The intermediate keys $\mathbf{13}_2$, $\mathbf{13}_3$ define the tabulator set positions. In case a tabulator key 31 in the keyboard 3 is actuated when the carriage indicator 9 is for example in a chain-lined position A after print start from the key $\mathbf{13}_1$, the carriage 8 moves rapidly without printing operation to the position of the key $\mathbf{13}_2$ from which the printing operation can be restarted. The tabulator setting key $\mathbf{13}_3$ performs the same function as that of the tabulator setting key $\mathbf{13}_2$.

In the circuit shown in FIG. 5, 25 are diodes for separating switch signals from different digits while 26 is a detector for detecting the digits of the closed switches to achieve tabulator settings in the corresponding digits. Said detector 26 can be easily composed in the known art for example from commercially available large-scale integreted circuits or other electronic components.

Upon removal of the tabulator setting key 13 from the panel 4 against the attractive force of the magnets 19, 20 the pressure-sensitive member 18 is released from the pressure by the push-bar 23 to interrupt the conduction between the corresponding terminals 16, 17 thereby clearing the tabulator setting in the corresponding digit.

Figure 6:
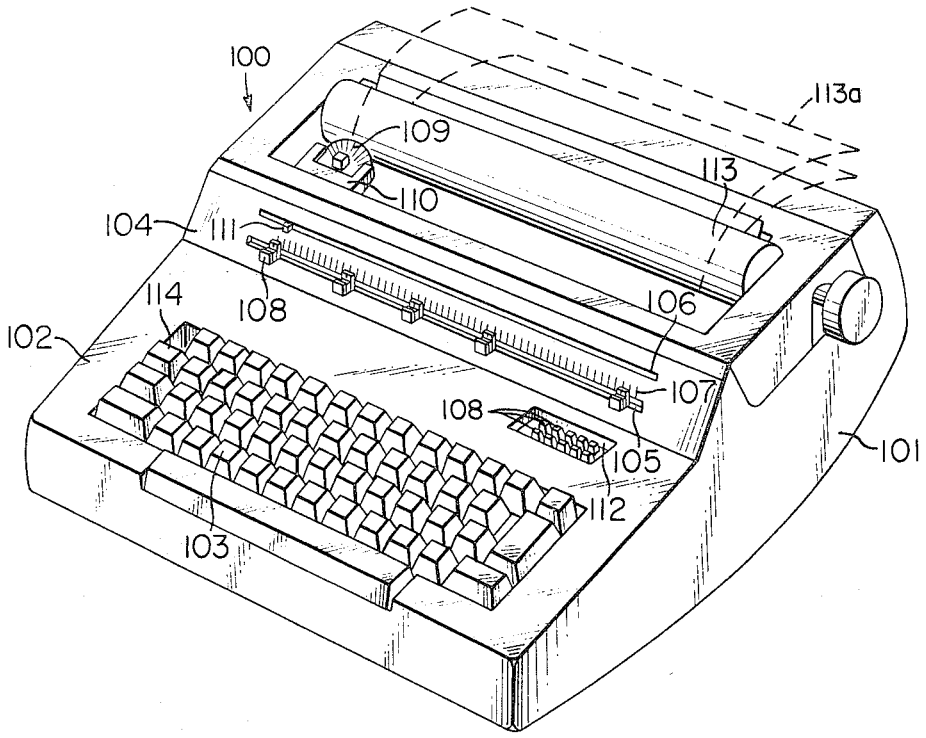
FIG. 6 is a perspective view of a typewriter embodying the present invention.

In the following another embodiment of the present invention is described. Reference is now made to FIG. 6 showing a typewriter 100 embodying the present invention, wherein a typewriter housing 101 is provided with a key operating plane 102 having a keyboard 103 thereon for printing of characters and numerals. An easily visible panel 104 made of a magnetic material such as iron extends at a substantially vertical angle from said key operating plane 102 and is provided thereon with a lateraly extended slit 105 for set switches 108 and with a narrower indicator slit 106 extending parallel to said slit 105. Along said slit 105 there are provided graduations 107 corresponding to the print digits, by means of which tabulator/margin set switches 108 are inserted into said slit 105. A carriage indicator 111 mounted on a carriage 110 bearing printing means 109 protrudes from said slit 106, and is displaced together with said carriage 110 thereby allowing constant visual confirmation of the position of said carriage 110. Also shown is a recess 112 for storing unused set switches 108, a platen 113 for supporting a printing paper 113*a* and a tabulator key 114.

Figure 7:
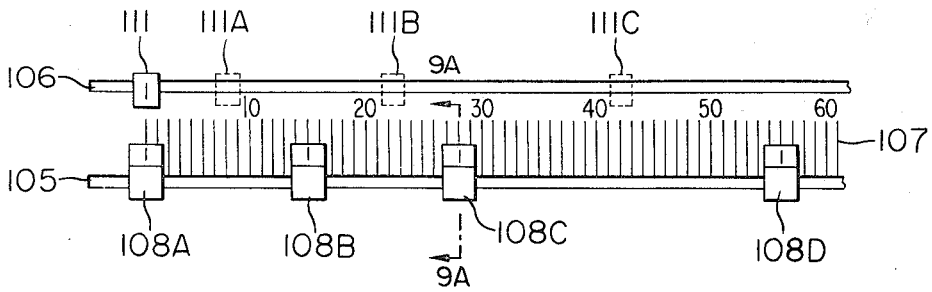
FIG. 7 is a magnified partial view of an example of the tabulator/margin-setting mechanism to be employed in the present invention.

FIG. 7 shows the detailed relationship among said set switch slit 105, set switches 108 positioned therein, indicator slit 106, carriage indicator 111 and graduations 107. In this example there are used four set switches 108A, 108B, 108C and 108D, which are collectively called set switches 108 in FIG. 6, in which the set switch 108A defines the left-margin position from which the printing operation can be initiated. In case the tabulator key 114 on the key operating plane 102 is actuated when the carriage indicator 111 has reached a broken-lined position 111A after the printing operation from said left-margin position by the actuation of alphanumeric keys in the keyboard 103, the carriage 110 rapidly moves without printing operation to a position corresponding to the set switch 108B. The printing operation can be restarted from this position by the alphanumeric keys in the keyboard 103, and if the tabulator key 114 is again actuated for example at a carriage position 111B, the carriage 110 moves without printing operation to a position of the set switch 108C. The printing operation can again be started from this position, and if the tabulator key 114 is actuated for example at a carriage position 111C, the carriage 110 moves without printing operation to the position of the set switch 108D defining the right-margin position. In the present embodiment the printing operation by said alphanumeric keys in the keyboard 103 beyond said right-margin position is prohibited by said set switch 108D, but it is also possible to allow, as in certain known typewriters, the printing operation in response to the alphanumeric keys in the keyboard 103 beyond said right-margin position, wherein an alarm is given to the operator when the carriage 110 reaches said right-margin position.

Figure 8A:
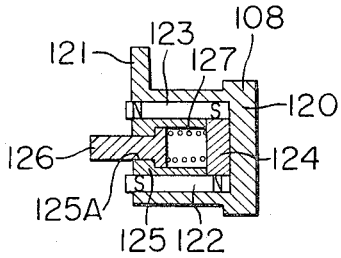
FIG. 8A is a lateral cross-sectional view of an example of the tabulator/margin-setting switch to be employed in the present invention.
Figure 8B:
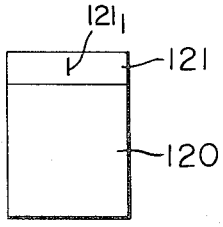
FIG. 8B is a front view thereof.

FIGS. 8A and 8B show an embodiment of the set switch 108 shown in FIG. 7, wherein a hollow casing 120 is provided with an integral projection 121 bearing a graduation 121, for indicating the tabulator or margin setting position as shown in FIG. 8B. In said casing 120 (on the lower and upper inner walls thereof in FIG. 8A) there are mounted magnets 122, 123 in such a manner that they slightly protrude from the lefthand end of said casing 120. Between said magnets 122, 123 there is provided a yoke 124 fixed to the inner wall of said casing 120, and a guide 125. In the hollow portion 125A of said guide 125 there is fitted a push-bar 126 of a substantially T-shaped cross section, said push-bar 126 being constantly biased outwards by a spring 127 provided in said guide 125.

Figure 9A:
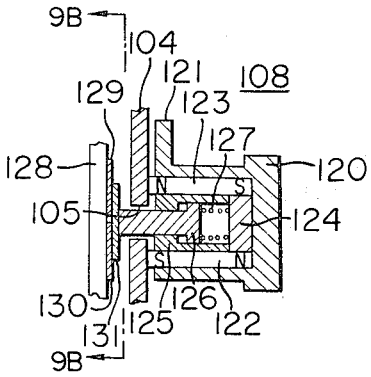
FIG. 9A is a cross-sectional view along the line 9A—9A in FIG. 7.
Figure 9B:
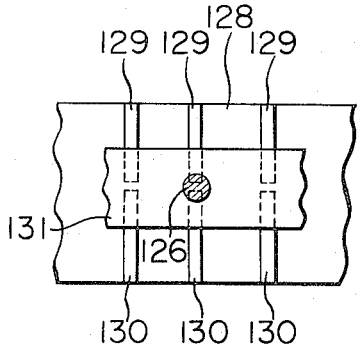
FIG. 9B is a cross-sectional view seen from the direction of arrows 9B—9B in FIG. 9A.

FIG. 9A shows a state in which the set switch 108 shown in FIG. 8A is inserted into the slit 105 of the panel 104 shown in FIG. 6 and maintained in position by said magnets 122, 123 for setting the tabulator or margin position. Behind said slit 105 and over the entire length thereof there is provided a printed circuit board 128, on the surface of which there are provided, as shown in FIG. 9B, electroconductive patterns 129, 130 at determined intervals, said patterns 129, 130 being positioned in facing relation to the push-bars 126 to be inserted into said slit 105. Also a pressure-sensitive electroconductive strip 131 is placed over said conductive patterns 129, 130 so as to cover the spacing therebetween constituting the switch circuits. Said strip 131 is maintained in constant contact with said patterns 129, 130 but shows conductivity only when it is pressed by the push-bar 126.

Figure 10:
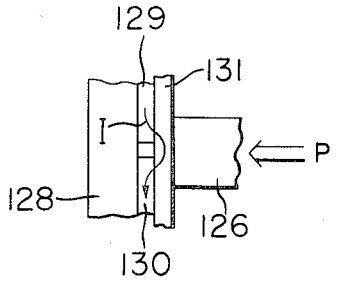
FIG. 10 is an explanatory view showing electric current flow through the pressure-sensitive conductive wires shown in FIG. 9A.

Said push-bar 126 of the set switch 108, constantly biased outwards by the spring 127, applies a pressure P exerted by said spring 127 to the pressure-sensitive strip 131 when the push-bar 126 of the set switch 108 is inserted into the slit 105 as shown in FIG. 9A and maintained in this position by the attractive force of the magnets 122, 123 to the magnetic panel 104. In this state the pressurized portion of the pressure-sensitive strip 131 is locally rendered electroconductive as shown in FIG. 10 to allow the passage of a current I as illustrated between the corresponding conductive patterns 129, 130 through said strip 131. The above-explained structure assures a high reliability since the pressure-sensitive strip 131 is pressed by a constant pressure which is determined by the force of the spring 127 which is not related to the pressure exerted by the operator at the insertion of said set switch 108. Also the failure in the current conduction resulting from the intrusion of foreign matter into the switch circuit portion can be prevented since said switch circuit portion of the patterns 129, 130 is entirely covered by said pressure-sensitive strip 131.

Figure 11:
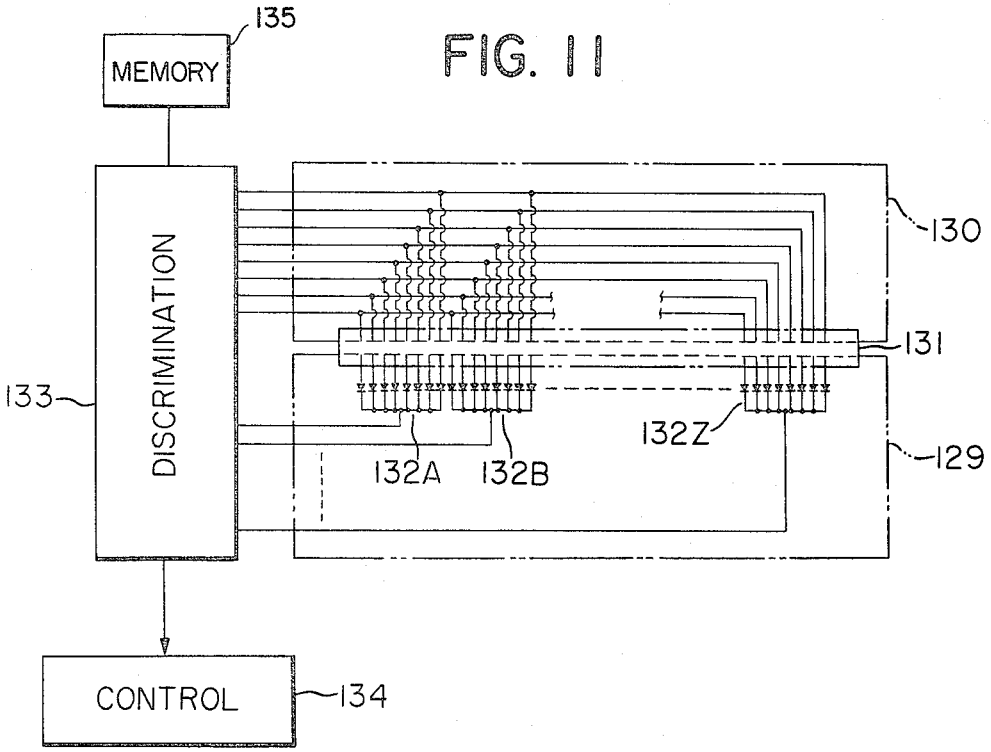
FIG. 11 is a circuit diagram showing an example of switching circuit pattern to be employed in the tabulator/margin-setting device of the present invention.

Said conductive patterns 129, 130 are formed according to the circuit shown in FIG. 11, so that patterns 129 are respectively connected to diodes 132A–132Z provided for preventing erroneous tabulator/margin setting in case plural set switches 108 are positioned.

133 is a discriminating circuit for identifying the circuits closed by the set switches 108 and supplying the corresponding identification signals to a control circuit 134 for controlling the carriage displacement in response to the actuation of the tabulator key 114. Said discriminating circuit 133 identifies the left-end one and right-end one of plural set switches 108 respectively as indicating the left-margin and right-margin positions, and the remaining set switches 108 as indicating the tabulator set positions. Such discriminating circuit 133 can be composed from the known art and from the commercially available large-scale integrated circuits. The positions of the set switches 108 may be stored in a memory 135 at the turning on of the power supply or during the course of the carriage displacement.

In the foregoing embodiment the conductive state in the switch circuits is achieved by the use of the pressure-sensitive strip 131 and set switches 108 for identifying the tabulator or margin set positions, but it is naturally possible also to identify said positions by the use of various equivalent switches.

What we claim is:

1. An electronic apparatus providing a margin and/or tabulator setting function, comprising:

printing means;

a carriage carrying said printing means;

carriage displacement means for initiating displacement of said carriage in response to entry of an instruction thereto and for stopping displacement of said carriage in response to a stop signal thereto; and tabulator/margin setting means, connected to said carriage displacement means, for generating stop signals to stop carriage displacement initiated by said displacement means at desired stop positions, said tabulator/margin setting means comprising a group of switches for setting said desired stop positions of said carriage, said group of switches comprising a printed circuit board having a plurality of open circuit patterns each corresponding respectively to a said desired stop position of said carriage, a pressure-sensitive electroconductive member adhered to said printed circuit board to cover said open circuit patterns, and at least one tabulator/margin setting resilient member mountable for selectively pressurizing an area of said pressure-sensitive electroconductive member corresponding to one said open circuit pattern at a desired stop position to thereby close said circuit pattern and produce a stop signal indicative thereof;

wherein said carriage, when displaced in response to an instruction to said carriage displacement means, is stopped at said tabulator/margin positions selected in accordance with the stop signals produced by said switches.

2. An electronic apparatus according to the claim 1, wherein said tabulator/margin setting resilient member is housed in a case provided with a tabulator/margin graduation and rendered detachably mountable on a panel of said apparatus.

3. An electronic apparatus according to claim 11, wherein said printing means is mounted on said carriage which is displaced in a serial manner.

4. An electronic apparatus according to the claim 2, wherein said panel is composed of a magnetic material, and said case is provided with a magnet capable of adhering to said panel.

5. An electronic apparatus according to claim 4, wherein said printing means is mounted on said carriage which is displaced in a serial manner.

6. An electronic apparatus according to claim 1, wherein said printing means is mounted on said carriage which is displaced in a serial manner.

7. A typewriter for printing on a recording medium, comprising:

a keyboard for generating printing signals;

a platen for carrying a recording medium;

a print head mounted for displacement relative to said platen and responsive to signals generated by said keyboard for printing on said recording medium;

a scale for indicating a printing position of said print head relative to said platen; and set means disposed adjacent to said scale for setting tabulating positions in the displacement of said print head relative to said platen, said set means including a plurality of pairs of electrodes and a member detachably mountable along said scale to selectively electrically connect said electrodes of any one of said pairs of electrodes and thereby produce a tabulation position signal indicating a tabulation position.

8. A typewriter according to claim 7, wherein said plurality of pairs of electrodes are provided on a printed board.

9. A typewriter according to claim 7, further comprising:

a housing unit to which said member is detachably mountable.

* * * * *

UNITED STATES PATENT AND TRADEMARK OFFICE

CERTIFICATE OF CORRECTION

PATENT NO. : 4,487,517

DATED : December 11, 1984

INVENTOR(S) : TOSHIAKI OZAWA, ET AL.

It is certified that error appears in the above-identified patent and that said Letters Patent is hereby corrected as shown below:

Column 3

Line 47, change "accomodated" to --accommodated--.

Column 5

Line 35, change "121," to --$121_1$--.

Column 7, line 15
(Claim 3, line 1)

Change "11" to --2--.

Signed and Sealed this

*Seventeenth* Day of *December 1985*

[SEAL]

*Attest:*

DONALD J. QUIGG

*Attesting Officer*

*Commissioner of Patents and Trademarks*